US010276285B2

(12) United States Patent
Matsumoto

(10) Patent No.: US 10,276,285 B2
(45) Date of Patent: Apr. 30, 2019

(54) CHIP RESISTOR

(71) Applicant: KOA Corporation, Ina-shi, Nagano (JP)

(72) Inventor: Kentaro Matsumoto, Ina (JP)

(73) Assignee: KOA Corporation, Ina-shi (JP)

( * ) Notice: Subject to any disclaimer, the term of this patent is extended or adjusted under 35 U.S.C. 154(b) by 0 days.

(21) Appl. No.: 15/764,570

(22) PCT Filed: Sep. 26, 2016

(86) PCT No.: PCT/JP2016/078225
§ 371 (c)(1),
(2) Date: Mar. 29, 2018

(87) PCT Pub. No.: WO2017/057248
PCT Pub. Date: Apr. 6, 2017

(65) Prior Publication Data

US 2018/0286541 A1 Oct. 4, 2018

(30) Foreign Application Priority Data

Sep. 30, 2015 (JP) ..... 2015-194663

(51) Int. Cl.
*H01C 1/142* (2006.01)
*H01C 1/148* (2006.01)
(Continued)

(52) U.S. Cl.
CPC ..... *H01C 1/142* (2013.01); *H01C 1/012* (2013.01); *H01C 1/148* (2013.01); *H01C 7/00* (2013.01);
(Continued)

(58) Field of Classification Search
CPC ..... H01C 1/142; H01C 1/012; H01C 17/006; H01C 17/281
(Continued)

(56) References Cited

U.S. PATENT DOCUMENTS 5,680,092 A * 10/1997 Yamada ..... H01C 7/006 338/308
6,462,304 B2 * 10/2002 Kaida ..... H01C 17/242 219/121.69
(Continued)

FOREIGN PATENT DOCUMENTS

JP 6-283302 A 10/1994
JP 10-275702 A 10/1998
(Continued)

OTHER PUBLICATIONS

JP 10-275702, Tanaka et al., Oct. 1998, machine translation of description.*
(Continued)

*Primary Examiner* — Kyung S Lee
(74) *Attorney, Agent, or Firm* — Crowell & Moring LLP

(57) ABSTRACT

Provided is a chip resistor including: a rectangular parallelepiped insulating substrate which is made of ceramics; a pair of front electrodes which are provided on lengthwise opposite end portions in a front surface of the insulating substrate; a resistive element which is provided between and connected to the two front electrodes; a protective layer which is made of a resin and which entirely covers the front surface of the insulating substrate including the two front electrodes and the resistive element; and a pair of cap-shaped end-surface electrodes which are provided on the lengthwise opposite end portions of the insulating substrate to establish electrical continuity to the front electrodes respectively; wherein: a chip element assembly in which the insulating substrate and the protective layer are laminated on each other but the end-surface electrodes have not been formed yet has an external shape substantially like a square cylinder.

5 Claims, 5 Drawing Sheets

(51) Int. Cl.
*H01C 7/00* (2006.01)
*H01C 1/012* (2006.01)
*H01C 17/00* (2006.01)
*H01C 17/28* (2006.01)

(52) U.S. Cl.
CPC ..... *H01C 17/006* (2013.01); *H01C 17/281* (2013.01)

(58) Field of Classification Search
USPC ..... 338/327
See application file for complete search history.

(56) References Cited

U.S. PATENT DOCUMENTS 6,609,292 B2 * 8/2003 Kurita ..... H01C 17/006 29/25.42
6,943,662 B2 * 9/2005 Tanimura ..... H01C 1/142 257/537
7,782,173 B2 * 8/2010 Urano ..... H01C 1/012 338/307
7,782,174 B2 * 8/2010 Urano ..... H01C 1/012 338/307
8,354,912 B2 * 1/2013 Yoneda ..... H01C 1/148 338/22 R
2009/0322468 A1 * 12/2009 Hanaoka ..... H01C 1/01 338/309
2010/0201477 A1 * 8/2010 Yang ..... H01C 1/032 338/309
2015/0061819 A1 * 3/2015 Ogawa ..... H01C 1/142 338/68
2016/0247610 A1 * 8/2016 Shinoura ..... H01C 1/142
2017/0309378 A1 * 10/2017 Matsumoto ..... H01C 1/142

FOREIGN PATENT DOCUMENTS

JP 2000-124001 A 4/2000
JP 2003-264101 9/2003
JP 2003-282304 A 10/2003
JP 2006-339589 A 12/2006
JP 2013-110304 A 6/2013

OTHER PUBLICATIONS

JP 2003-264101, Hanaoka et al., Sep. 2003, machine translation of description.*
International Search Report (PCT/ISA/210) issued in PCT Application No. PCT/JP2016/078225 dated Nov. 22, 2015 with English-language translation (five (5) pages).
Japanese-language Written Opinion (PCT/ISA/237) issued in PCT Application No. PCT/JP2016/078225 dated Nov. 22, 2015 (four (4) pages).

* cited by examiner

CHIP RESISTOR

TECHNICAL FIELD

The present invention relates to a chip resistor which is surface-mounted on a circuit board by soldering. Particularly, it relates to a chip resistor suitable for bulk mounting.

BACKGROUND ART

Generally, a chip resistor includes a rectangular parallelepiped insulating substrate, a pair of front electrodes, a resistive element, an insulating protective layer, a pair of back electrodes, a pair of end-surface electrodes, and a pair of external electrodes. The insulating substrate is made of ceramics. The pair of front electrodes are disposed on a front surface of the insulating substrate so as to be opposite to each other with interposition of a predetermined interval therebetween. The resistive element is provided on the front surface of the insulating substrate so as to be connected to the pair of front electrodes. The protective layer is provided so as to cover the resistive element. The pair of back electrodes are disposed on a back surface of the insulating substrate so as to be opposite to each other with interposition of a predetermined interval therebetween. The pair of end-surface electrodes are provided on opposite end surfaces of the insulating substrate so as to establish electrical continuity between the front electrodes and the back electrodes respectively. The pair of external electrodes are formed by plating treatment on outer surfaces of the end-surface electrodes.

The chip resistor configured thus is surface-mounted on a circuit board in the following manner. That is, after a solder paste is printed on lands provided on the circuit board, the external electrodes of the chip resistor are mounted on the lands with the back electrodes down. In this state, the solder paste is melted and solidified. Thus, the chip resistor is surface-mounted on the circuit board. On this occasion, no problem arises when the chip resistor assumes a posture at which the back surface of the insulating substrate faces down. When the chip resistor assumes another posture at which one of side surfaces of the insulating substrate on which no electrode is present faces down, it is however difficult to bring the electrodes into tight contact with the solder paste on the lands to thereby result in shortage of solder connection strength (fixability). Therefore, the chip resistor in which no electrode is formed on each of the side surfaces of the insulating substrate is not suitable for bulk mounting.

As a background-art example of a chip resistor adapted for bulk mounting, the following technique has been known, as described in PTL 1. That is, in a producing process for obtaining a large number of individual chip element assemblies from a large-sized substrate, the large-sized substrate is primarily broken along primary division grooves to thereby obtain strip-shaped substrates. Then, a silver paste is applied onto end surfaces of the strip-shaped substrates to form end-surface electrodes. During that time, the silver paste is not only applied onto the end surfaces but also made to flow into secondary division grooves. Then, the strip-shaped substrates are secondarily broken along the secondary division grooves so as to be separated into the individual chip element assemblies. In each of chip resistors produced thus, side-surface electrodes connected to the end-surface electrodes are also formed on the side surfaces of the chip element assembly which are secondary break surfaces, and electrodes are present on four surfaces including the front and back of a rectangular parallelepiped insulating substrate. Accordingly, the chip resistor can be mounted at a posture having any of the four surfaces (an upper surface, a lower surface and the opposite side surfaces) on a circuit board.

In addition, as another background-art example of the chip resistor adapted for bulk mounting, the following configuration has been known, as described in PTL 2. That is, two ceramics substrates are bonded to each other to forma chip element assembly shaped like a rectangular cylinder. A resistive element and a pair of internal electrodes are provided between the ceramics substrates. Moreover, cap-shaped end-surface electrodes are provided on lengthwise opposite end portions of the chip element assembly. The end-surface electrodes are connected to the internal electrodes which are exposed from lengthwise opposite end surfaces of the ceramics substrates. According to the chip resistor configured thus, the cap-shaped end-surface electrodes extend to an upper surface, a lower surface and opposite side surfaces of the chip element assembly, and the chip element assembly has an external shape like a rectangular cylinder having the same dimensions on each of the four surfaces. Accordingly, the chip resistor can be mounted at a posture having any of the four surfaces (the upper surface, the lower surface and the opposite side surfaces) on the circuit board.

CITATION LIST

Patent Literature

PTL 1: JP-A-2000-124001
PTL 2: JP-A-6-283302

SUMMARY OF INVENTION

Technical Problem

However, in the method for forming the side-surface electrodes using the division grooves provided in the large-sized substrate, as in the chip resistor disclosed in PTL 1, a plate thickness of the insulating substrate or the large-sized substrate is reduced as the size of the chip resistor is reduced. Then, a groove depth of each of the division grooves becomes very shallow. Therefore, there is a problem that each of the side-surface electrodes cannot be formed with a required size. In addition, only portions on an upper surface side and a lower surface side in the side surfaces of the insulating substrate are side-surface electrode formation regions. Therefore, each of electrode areas is smaller and fixability is poorer than in a case where the chip resistor is mounted with the upper surface or the lower surface of the insulating substrate down. Further, the shape of each of the side-surface electrodes is not linear. Therefore, there is a problem that a self-alignment property is conspicuously poor. Moreover, in the chip resistor disclosed in PTL 1, a front surface of the protective layer protrudes higher than an upper surface of each of the end-surface electrodes. Therefore, when the chip resistor is mounted with the protective layer down, there is a problem that a chip standing phenomenon called Manhattan phenomenon is apt to occur.

On the other hand, in the chip resistor disclosed in PTL 2, the resistive element and the internal electrodes are embedded in the rectangularly cylindrical chip element assembly which is formed by bonding the two ceramics substrates to each other, and the cap-shaped end-surface electrodes are formed on the opposite end portions of such a chip element assembly. Accordingly, stable bulk mounting having no directivity can be performed. However, after the resistive element and the internal electrodes are formed on an unfired green sheet which will serve as a ceramic substrate, a step of pasting another green sheet on the green sheet and firing the green sheets is required. There is therefore a drawback that the producing method is extremely difficult. A resistance value varies easily due to thermal contraction generated when the green sheets are fired. Further, the resistive element and the internal electrodes are formed inside the chip element assembly. There is therefore also another problem that trimming adjustment forming a trimming groove is impossible to be performed.

The present invention has been accomplished in consideration of the aforementioned actual circumstances inherent in the background art. An object of the present invention is to provide a chip resistor whose production is easy and which is suitable for bulk mounting.

Solution to Problem

In order to attain the foregoing object, the present invention provides a chip resistor configured to include: a rectangular parallelepiped insulating substrate which is made of ceramics; a pair of front electrodes which are provided on lengthwise opposite end portions in a front surface of the insulating substrate; a resistive element which is provided between and connected to the two front electrodes; an insulating protective layer which entirely covers the front surface of the insulating substrate including the resistive element and the two front electrodes; and a pair of cap-shaped end-surface electrodes which are provided on the lengthwise opposite end portions of the insulating substrate to be connected to the front electrodes respectively; wherein: a laminate in which the insulating substrate and the protective layer are put on top of each other has an external shape substantially like a square cylinder.

In the chip resistor configured thus, the front surface of the insulating substrate is entirely covered with the protective layer. The laminate in which the insulating substrate and the protective layer are put on top of each other has the external shape substantially like a square cylinder. The end-surface electrodes are formed to have the same dimensions on each of four surfaces including an exposed surface of the protective layer and the remaining three surfaces. Therefore, bulk mounting with no directivity in terms of front, back, etc. can be performed. Moreover, a front surface of the protective layer is not higher than each of upper surfaces of the end-surface electrodes. Therefore, stable bulk mounting free from a chip standing phenomenon can be performed. In addition, since the front electrodes and the resistive element are formed on the front surface of the insulating substrate, a variation in resistance value can be reduced and a trimming groove etc. can be formed easily to adjust the resistance value.

In the aforementioned configuration, an insulating undercoat layer which entirely covers the front surface of the insulating substrate including the resistive element and the two front electrodes is formed on a lower layer of the protective layer. Then, steps between the resistive element and the two front electrodes can be absorbed by the undercoat layer. Thus, the front surface of the protective layer can be formed as a smoother surface. Accordingly, the four surfaces including the exposed surface of the protective layer and the remaining three surfaces are smooth surfaces having the same dimensions as one another. Since the end-surface electrodes are formed on the smooth surfaces having the same dimensions as one another in this manner, more stable bulk mounting can be performed.

In addition, in the aforementioned configuration, it is preferable that each of the front electrodes is exposed from three end surfaces of the insulating substrate which are continuous to one another in a U-shape, and a corresponding one of the end-surface electrodes is connected to the respective exposed portions of the front electrode. Then, connection reliability between the front electrodes and the end-surface electrodes can be increased.

In addition, in the aforementioned configuration, it is preferable that the protective layer is similar in color to the insulating substrate. Then, the exposed surface of the protective layer and the remaining three ceramics surfaces in the chip resistor are similar in color. Accordingly, the color of the chip resistor seen from any direction is always the same when an image about a mounting state of the chip resistor is processed.

Advantageous Effects of Invention

According to the present invention, the end-surface electrodes can be formed to have the same dimensions on each of the four surfaces including the exposed surface of the protective layer and the remaining three surfaces. Accordingly, the chip resistor suitable for bulk mounting can be easily produced by a simple process.

DESCRIPTION OF EMBODIMENTS

Figure 1:
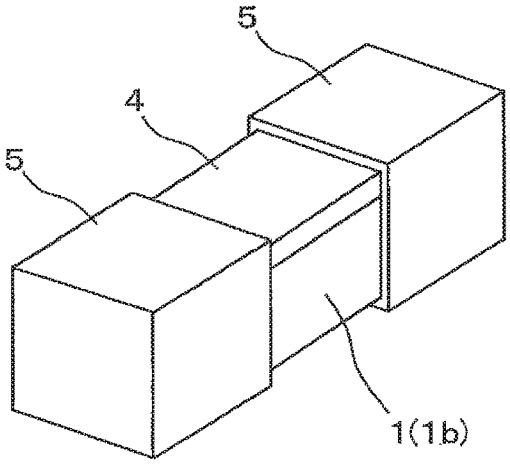
FIG. 1 A perspective view of a chip resistor according to a first embodiment of the present invention.

A mode for carrying out the invention will be described below with reference to the drawings. As shown in FIGS. 1 to 6, a chip resistor according to an embodiment of the present invention is mainly constituted by a rectangular parallelepiped insulating substrate 1, a pair of front electrodes 2, a rectangular resistive element 3, a protective layer 4, and a pair of end-surface electrodes 5. The pair of front electrodes 2 are provided on lengthwise opposite end portions in a front surface of the insulating substrate 1. The resistive element 3 is provided so as to be connected to the front electrodes 2. The protective layer 4 covers the whole of the front surface of the insulating substrate 1 including the two front electrodes 2 and the resistive element 3. The pair of end-surface electrodes 5 are provided on the lengthwise opposite end portions of the insulating substrate 1.

The insulating substrate 1 is made of ceramics. A large-sized substrate which will be described later is diced along primary division lines and secondary division lines which extend lengthwise and widthwise. Thus, a large number of such insulating substrates 1 are obtained.

The pair of front electrodes 2 are obtained by screen-printing, drying and firing an Ag-based paste. Each of the front electrodes 2 is formed into a rectangle or a square so as to be exposed from three end surfaces of the insulating substrate 1. The three end surfaces are continuous to one another in a U-shape.

The resistive element 3 is obtained by screen-printing, drying and firing a resistive paste of ruthenium oxide or the like. Lengthwise opposite end portions of the resistive element 3 overlap with the front electrodes 2 respectively. Incidentally, although not shown, a trimming groove is formed in the resistive element 3 in order to adjust a resistance value thereof.

Figure 3:
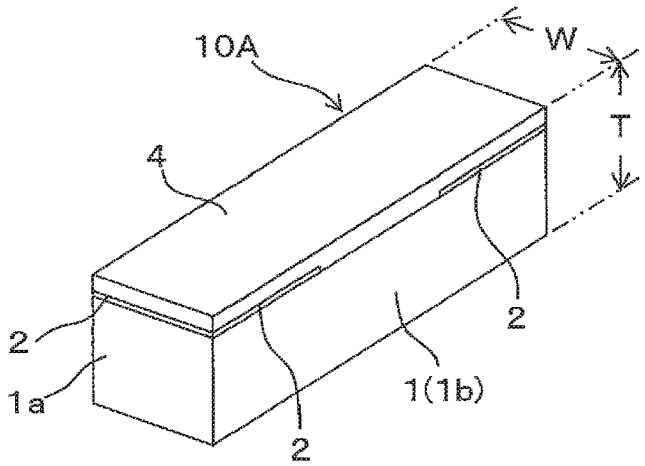
FIG. 3 A perspective view showing a chip element assembly in which end-surface electrodes have not been formed yet.
Figure 4:
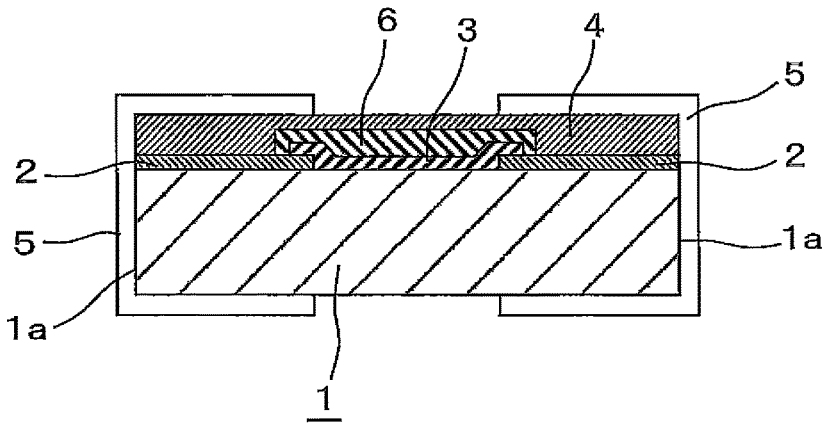
FIG. 4 A sectional view taken along a line IV-IV of FIG. 2.
Figure 5:
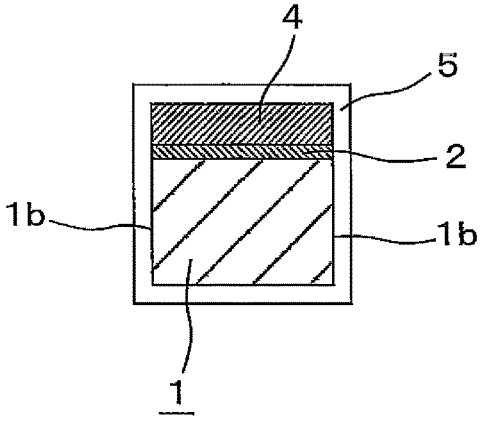
FIG. 5 A sectional view taken along a line V-V of FIG. 2.
Figure 6:
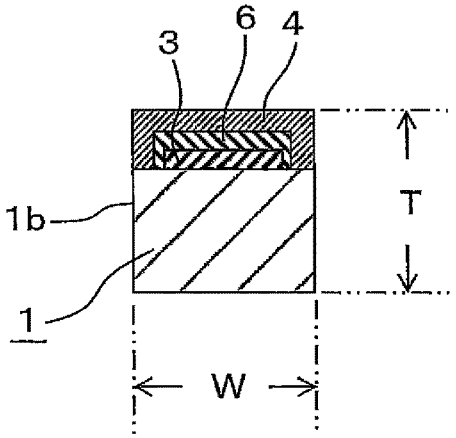
FIG. 6 A sectional view taken along a line VI-VI of FIG. 2

The protective layer 4 is an overcoat layer which is obtained by screen-printing and thermally curing an epoxy-based resin paste. In order to reduce damage to the resistive element 3 when the trimming groove is formed, an undercoat layer 6 is formed on a lower side of the protective layer 4 to cover the resistive element 3. Incidentally, the undercoat layer 6 is obtained by screen-printing, drying and firing a glass paste. The protective layer 4 is formed to cover the whole of the front surface of the insulating substrate 1 including the two front electrodes 2 and the resistive element 3. Accordingly, three end surfaces including a left end of the front electrode 2 positioned on a left side in FIG. 3 and FIG. 4 are exposed from a space between the insulating substrate 1 and the protective layer 4. Three end surfaces including a right end of the front electrode 2 positioned on a right side in FIG. 3 and FIG. 4 are exposed from the space between the insulating substrate 1 and the protective layer 4.

The protective layer 4 is formed to be similar in color to the ceramics which is the material of the insulating substrate 1. In the configuration according to the embodiment, white pigment (e.g. titanium oxide) added to an epoxy-based resin paste is used for the protective layer 4 so that the whole of the front surface of the insulating substrate 1 which is white is covered with the protective layer 4 which is white. The protective layer 4 however does not have to be always white but may be formed into another color such as black or gray.

Figure 2:
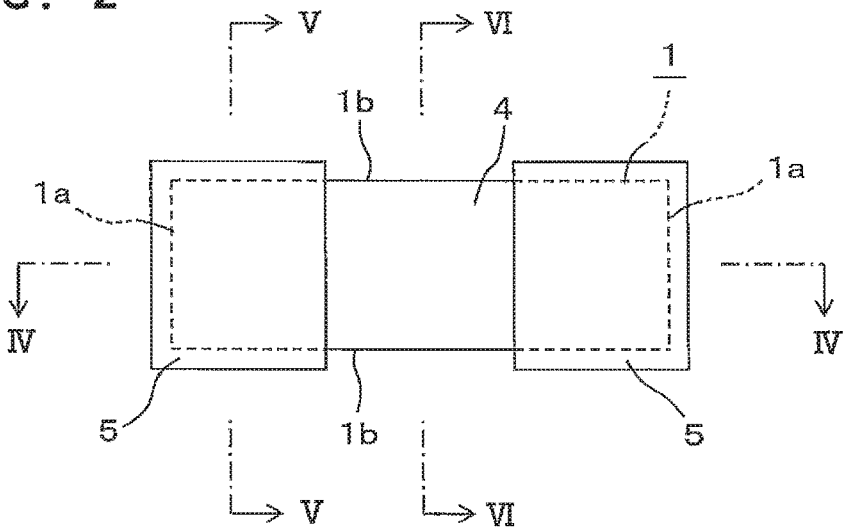
FIG. 2 A plan view of the chip resistor.

The pair of end-surface electrodes 5 are obtained by dip-coating and thermally curing an Ag paste or a Cu paste. These end-surface electrodes 5 are formed into a cap shape so as to cover opposite end surfaces 1*a* of the insulating substrate 1, an upper surface of the protective layer 4 and a lower surface and opposite side surfaces 1*b* of the insulating substrate 1. Thus, the end-surface electrode 5 positioned on the left side in FIG. 2 and FIG. 4 is connected to the three end surfaces of the left front electrode 2 exposed from the space between the insulating substrate 1 and the protective layer 4, and the end-surface electrode 5 positioned on the right side in FIG. 2 and FIG. 4 is connected to the three end surfaces of the right front electrode 2 exposed from the space between the insulating substrate 1 and the protective layer 4.

Although not shown, the pair of end-surface electrodes 5 are covered with external electrodes. Front surfaces of the end-surface electrodes 5 are electroplated with Ni, Sn, or the like. Thus, these external electrodes are formed.

Here, as shown in FIG. 3, a chip element assembly 10A in which the end-surface electrodes 5 have not been formed yet has an external shape substantially like a square cylinder in the chip resistor according to the first embodiment. The cap-shaped end-surface electrodes 5 are formed on lengthwise opposite end portions of the chip element assembly 10A having such a shape. That is, the insulating substrate 1 is shaped like a rectangular parallelepiped having a thickness shorter than a width. The protective layer 4 is laminated so as to cover the whole of the front surface of the insulating substrate 1. Thus, the chip element assembly 10A (e.g. width W=0.125 mm, thickness T=0.125 mm) is configured to have the width W and the thickness T which are made equal to each other.

In the chip resistor according to the first embodiment, as described above, the whole of the front surface of the insulating substrate 1 made of the ceramics is covered with the protective layer 4. The chip element assembly 10A in which the insulating substrate 1 and the protective layer 4 are laminated on each other has the external shape substantially like a square cylinder. A variation in height caused by the thickness of the insulating substrate 1 can be adjusted by a thickness of the protective layer 4. Therefore, the chip element assembly 10A can be accurately shaped like a square cylinder. Since the cap-shaped end-surface electrodes 5 are formed on the lengthwise opposite end portions of the chip element assembly 10A having such a shape, each of the end-surface electrodes 5 can be extended on the four surfaces including an exposed surface of the protective layer 4 and the remaining three surfaces so as to have the same dimensions on each of the four surfaces. Accordingly, the chip resistor can be mounted in the same way even if the chip resistor assumes any posture among the four surfaces. Stable bulk mounting with no directivity in terms of front, back, etc. can be performed. Since the front surface of the protective layer 4 can be prevented from being higher than each of upper surfaces of the end-surface electrodes 5, stable bulk mounting free from a chip standing phenomenon can be performed. In addition, since the front electrodes 2 and the resistive element 3 are formed on the front surface of the insulating substrate 1, a variation in resistance value can be reduced and a trimming groove etc. can be formed easily to adjust the resistance value.

In addition, in the chip resistor according to the first embodiment, each of the front electrodes 2 is exposed from the three end surfaces of the insulating substrate 1 which are continuous to one another in the U-shape, and a corresponding one of the end-surface electrodes 5 is connected to the respective exposed portions of the front electrode 2. Accordingly, connection reliability between the front electrodes 2 and the end-surface electrodes 5 can be increased.

In addition, in the chip resistor according to the first embodiment, the protective layer 4 is formed in white which is similar in color to the ceramics of the insulating substrate 1. Accordingly, the exposed surface of the protective layer 4 and the remaining three ceramics surfaces are similar in color. Thus, when an image is taken and processed as to whether the chip resistor has been accurately mounted on lands of a circuit board or not, the image is always taken in the same color regardless of the mounting posture of the chip resistor. Thus, the image can be processed easily and with high accuracy.

Next, a method for producing the chip resistor configured as described above will be described with reference to FIGS. 7A-7F and FIGS. 8A-8E.

Figure 7A:
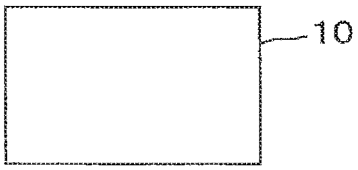
FIGS. 7A-7F Explanatory views showing producing steps of the chip resistor.
Figure 8A:
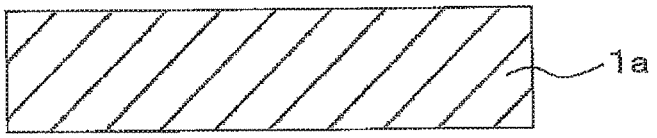
FIGS. 8A-8E Explanatory views showing the producing steps of the chip resistor.

First, as shown in FIG. 7A and FIG. 8A, a large-sized substrate 10 which is made of ceramics and from which a large number of insulating substrates 1 can be obtained is prepared. Primary division grooves or secondary division grooves are not formed in the large-sized substrate 10.

Figure 7D:
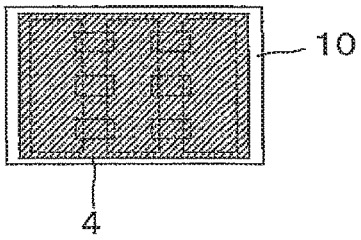
Figure 7B:
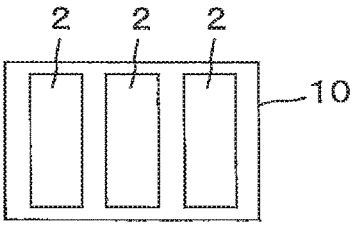
Figure 7E:
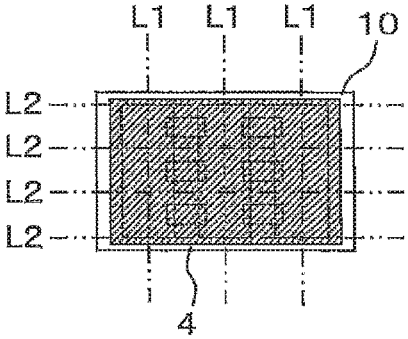

However, in a subsequent step shown in FIG. 7E, the large-sized substrate 10 will be diced along primary division lines L1 and secondary division lines L2 extending lengthwise and widthwise, and each of grids partitioned by the two division lines L1 and L2 will serve as a chip formation region for one chip resistor. Incidentally, FIGS. 7A-7F show states in which the large-sized substrate 10 is viewed planarly. FIGS. 8A-8E show states in which each of the chip formation regions for one chip resistor in FIGS. 7A-7F is viewed sectionally.

Figure 8B:
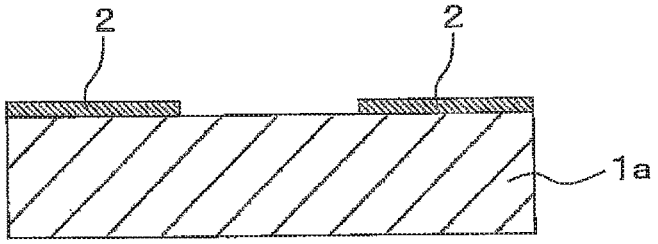

An Ag-based paste printed on a front surface of such a large-sized substrate 10 is dried and fired. Thus, as shown in FIG. 7B and FIG. 8B, a plurality of pairs of front electrodes 2 which extend like belts at predetermined intervals are formed on the front surface of the large-sized substrate 10.

Figure 7C:
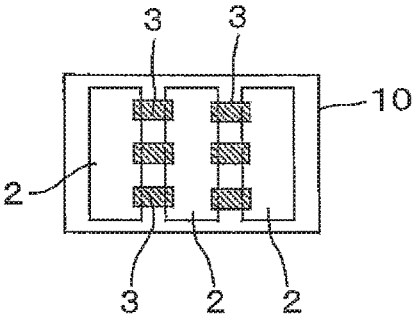
Figure 8C:
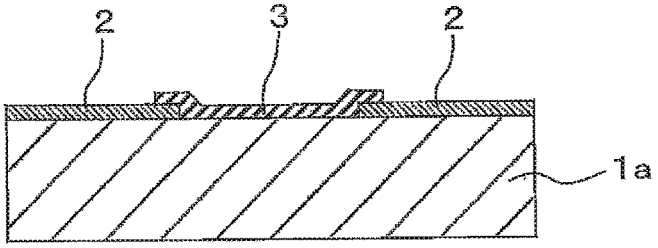

Next, a resistive element paste of ruthenium oxide or the like screen-printed on the front surface of the large-sized substrate 10 is dried and fired. Thus, as shown in FIG. 7C and FIG. 8C, each of resistive elements 3 is formed to be laid between, of the front electrodes 2, corresponding ones paired with each other. Incidentally, a sequence for forming the front electrodes 2 and the resistive elements 3 may be reverse to the aforementioned one.

Figure 8D:
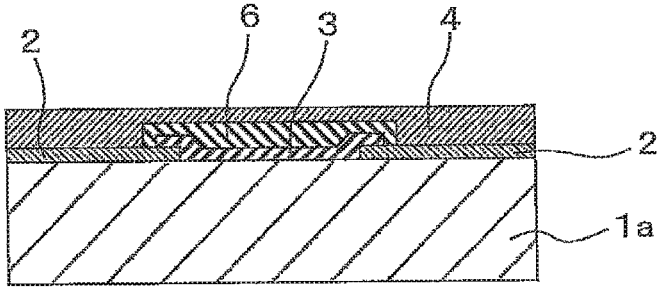

Next, as a material for reducing damage to the resistive elements 3 during formation of trimming grooves, a glass paste is screen-printed, dried and fired. Thus, an undercoat layer 6 is formed to cover the resistive elements 3. After the belt-like front electrodes 2 are cut individually by a laser etc. along the secondary division lines L2 which will be diced in the subsequent step, the trimming grooves (not shown) are formed in the resistive elements 3 from above the undercoat layer 6 to thereby adjust resistance values of the resistive elements 3. Thereafter, an epoxy-based resin paste added with white pigment is screen-printed on the undercoat layer 6 and thermally cured. Thus, as shown in FIG. 7D and FIG. 8D, a white protective layer 4 is formed to entirely cover the chip formation regions of the large-sized substrate 10 including the front electrodes 2 and the resistive elements 3.

Figure 7F:
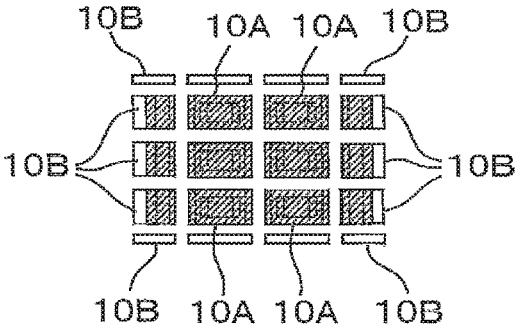

Next, as shown in FIG. 7E, the large-sized substrate 10 is cut along the primary division lines L1 and the secondary division lines L2 by a dicing blade. The primary division lines L1 pass through widthwise central portions of the front electrodes 2 and extend in a lengthwise direction. The secondary division lines L2 intersect the primary division lines L1 perpendicularly. As a result, as shown in FIG. 7F, individual chip element assemblies 10A each of which is made to have substantially same external shape as that of the chip resistor are obtained. As described above, each of the chip element assemblies 10A has an external shape substantially like a square cylinder (see FIG. 3). At this point of time, a width W and a thickness T of the chip element assembly 10A are equal to each other. Incidentally, a peripheral portion of the large-sized substrate 10 is a dummy region surrounding the respective chip formation regions. The dummy region is discarded after dicing and thrown away as substrates 10B. In addition, the primary division lines L1 and the secondary division lines L2 are virtual lines set on the large-sized substrate 10. As described above, neither primary division grooves nor secondary division grooves corresponding to the division lines are formed in the large-sized substrate 10.

Figure 8E:
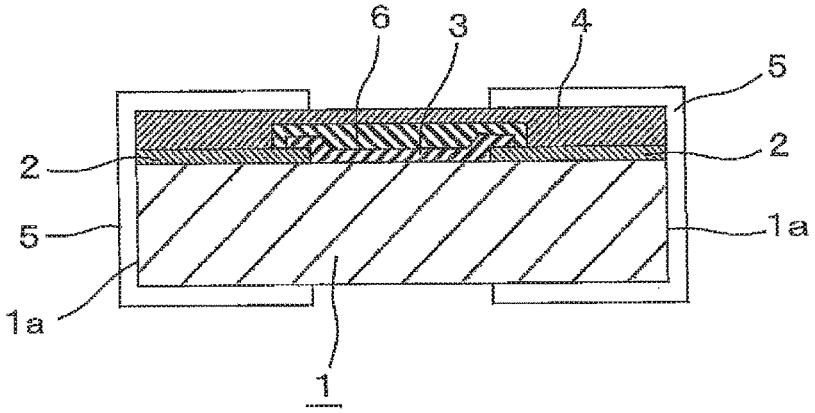

Next, an electrically conductive paste such as an Ag paste or a Cu paste is dip-coated on end surfaces of the chip element assemblies 10A and thermally cured. Thus, cap-shaped end-surface electrodes 5 are formed to extend from lengthwise opposite end surfaces of the chip element assemblies 10A and reach predetermined positions of widthwise opposite end surfaces of the chip element assemblies 10A, as shown in FIG. 8E. On this occasion, each of the chip element assemblies 10A has the external shape substantially like a square cylinder. Accordingly, each of the end-surface electrodes 5 reaching the four surfaces of the chip element assembly 10A have rectangular or square shapes on the front surface of the protective layer 4 and the remaining three ceramics surfaces, and the rectangular or square shapes have the same dimensions as one another.

Finally, the individual chip element assemblies 10A are electroplated with Ni, Si, or the like. Thus, not-shown external electrodes are formed to cover the end-surface electrodes 5. As a result, chip resistors as shown in FIG. 1 and FIG. 2 are completed.

Figure 9:
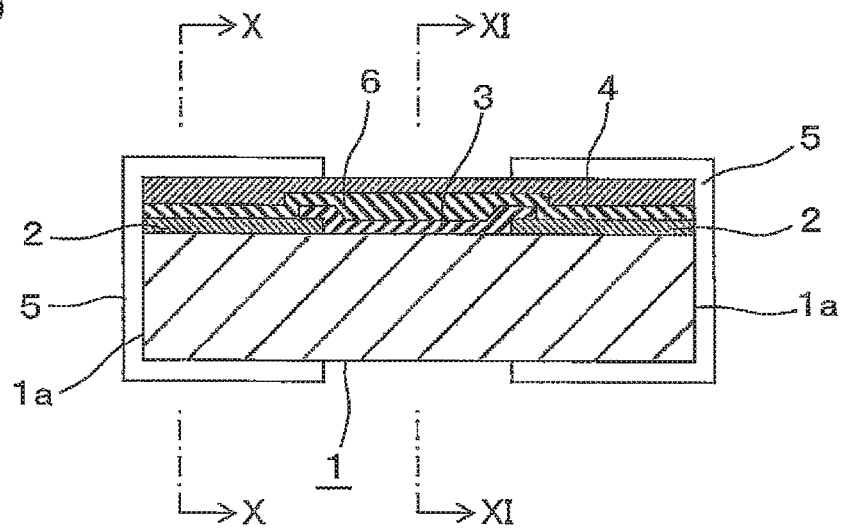
FIG. 9 A sectional view of a chip resistor according to a second embodiment of the present invention.
Figure 10:
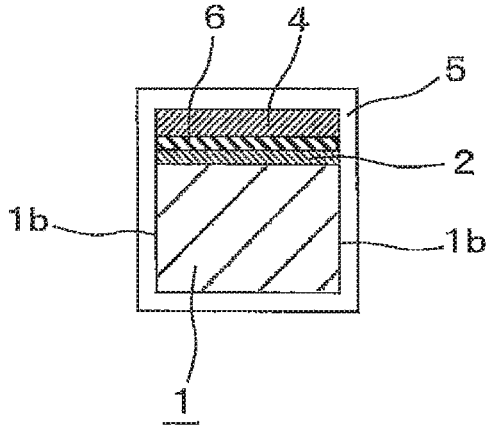
FIG. 10 A sectional view taken along a line X-X of FIG. 9.
Figure 11:
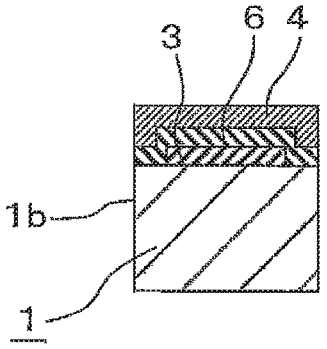
FIG. 11 A sectional view taken along a line XI-XI of FIG. 9.

FIGS. 9 to 11 are views for explaining a chip resistor according to a second embodiment of the present invention. In FIGS. 9 to 11, corresponding portions to those in FIGS. 1 to 6 are referred to by the same signs respectively.

The second embodiment is different from the aforementioned first embodiment in that an undercoat layer 6 entirely covers a front surface of an insulating substrate 1 including two front electrodes 2 and a resistive element 3. The second embodiment is fundamentally the same in the remaining configuration as the aforementioned first embodiment. Duplicate description about the remaining configuration will be therefore omitted here. That is, the chip resistor according to the second embodiment is mainly constituted by the insulating substrate 1, the pair of front electrodes 2, the resistive element 3, the undercoat layer 6, a protective layer 4, and a pair of end-surface electrodes 5. The insulating substrate 1 is shaped like a rectangular parallelepiped. The pair of front electrodes 2 are provided on lengthwise opposite end portions in the front surface of the insulating substrate 1. The resistive element 3 is shaped like a rectangle and provided so as to be connected to the front electrodes 2. The undercoat layer 6 entirely covers the front surface of the insulating substrate 1 including the two front electrodes 2 and the resistive element 3. The protective layer 4 entirely covers an upper surface of the undercoat layer 6. The pair of end-surface electrodes 5 are provided on the lengthwise opposite end portions of the insulating substrate 1.

In the thus configured chip resistor according to the second embodiment, the undercoat layer 6 which entirely covers the front surface of the insulating substrate 1 including the resistive element 3 and the two front electrodes 2 is formed on a lower side of the protective layer 4, and steps generated at overlapping portions between the resistive element 3 and the two front electrodes 2 respectively are absorbed by the undercoat layer 6. Accordingly, a front surface of the protective layer 4 can be formed as a smoother surface so that four surfaces including an exposed surface of the protective layer 4 and the remaining three surfaces can be smooth surfaces having the same dimensions as one another. Since the end-surface electrodes 5 are formed on the smooth surfaces having the same dimensions as one another in this manner, more stable bulk mounting can be performed. In addition, even in the case where an Ag paste is used to form the front electrodes 2, the undercoat layer 6 covers the insulating substrate 1 including the front electrodes 2. Thus, the front electrodes 2 can be prevented from being easily sulfurized. Thus, a chip resistor free from migration can be realized.

REFERENCE SIGNS LIST

1 insulating substrate
2 front electrode

3 resistive element
4 protective layer
5 end-surface electrode
6 undercoat layer
10 large-sized substrate
10A chip element assembly
L1 primary division line
L2 secondary division line

The invention claimed is:

1. A chip resistor comprising: a rectangular parallelepiped insulating substrate which is made of ceramics; a pair of front electrodes which are provided on lengthwise opposite end portions in a front surface of the insulating substrate; a resistive element which is provided between and connected to the two front electrodes; an insulating protective layer which entirely covers the front surface of the insulating substrate including the resistive element and the two front electrodes; and a pair of cap-shaped end-surface electrodes which are provided on the lengthwise opposite end portions of the insulating substrate to be connected to the front electrodes respectively; wherein: a laminate in which the insulating substrate and the protective layer are put on top of each other has an external shape substantially like a square cylinder and the pair of cap-shaped end-surface electrodes are formed to have same dimensions on each of four surfaces including an exposed surface of the protective layer and three other surfaces.

2. A chip resistor according to claim 1, wherein: an insulating undercoat layer which entirely covers the front surface of the insulating substrate including the resistive element and the two front electrodes is formed on a lower layer of the protective layer.

3. A chip resistor according to claim 1, wherein: each of the front electrodes is exposed from three end surfaces of the insulating substrate which are continuous to one another in a U-shape, and a corresponding one of the end-surface electrodes is connected to the respective exposed portions of the front electrode.

4. A chip resistor according to claim 2, wherein: each of the front electrodes is exposed from three end surfaces of the insulating substrate which are continuous to one another in a U-shape, and a corresponding one of the end-surface electrodes is connected to the respective exposed portions of the front electrode.

5. A chip resistor according to claim 1, wherein: the protective layer is similar in color to the insulating substrate.

* * * * *